US007866405B2

(12) United States Patent
Richards et al.

(10) Patent No.: US 7,866,405 B2
(45) Date of Patent: Jan. 11, 2011

(54) SECUREMENT OF LINES TO WELL SAND CONTROL SCREENS

(75) Inventors: William M. Richards, Frisco, TX (US); Tommy F. Grigsby, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/180,105

(22) Filed: Jul. 25, 2008

(65) Prior Publication Data

US 2010/0018697 A1 Jan. 28, 2010

(51) Int. Cl.
*E21B 19/16* (2006.01)

(52) U.S. Cl. ..... 166/380; 166/227; 166/385

(58) Field of Classification Search ..... 166/385, 166/227, 228, 235, 378, 380; 29/896.61
See application file for complete search history.

(56) References Cited

U.S. PATENT DOCUMENTS

| | | | | |
|---|---|---|---|---|
| 6,186,229 | B1 | 2/2001 | Martin et al. | |
| 6,302,203 | B1 | 10/2001 | Rayssiguier et al. | |
| 6,412,565 | B1 | 7/2002 | Castano-Mears | |
| 6,415,869 | B1 | 7/2002 | Smith | |
| 6,554,064 | B1 | 4/2003 | Restarick et al. | |
| 6,681,854 | B2 | 1/2004 | Danos | |
| 6,684,951 | B2 | 2/2004 | Restarick et al. | |
| 6,789,621 | B2 | 9/2004 | Wetzel et al. | |
| 6,817,410 | B2 | 11/2004 | Wetzel et al. | |
| 6,983,796 | B2 | 1/2006 | Bayne et al. | |
| 7,063,143 | B2 | 6/2006 | Tilton et al. | |
| 7,104,324 | B2 | 9/2006 | Wetzel et al. | |
| 7,131,494 | B2 * | 11/2006 | Bixenman et al. | 166/297 |
| 7,165,892 | B2 | 1/2007 | Grigsby et al. | |
| 7,168,485 | B2 * | 1/2007 | Johnson et al. | 166/207 |
| 7,182,134 | B2 | 2/2007 | Wetzel et al. | |
| 7,220,067 | B2 | 5/2007 | Rubinstein et al. | |

(Continued)

FOREIGN PATENT DOCUMENTS

| | | |
|---|---|---|
| WO | WO02055841 | 9/2003 |

OTHER PUBLICATIONS

Oil & Gas Journal, vol. 101, issue 13, "Fiber Optics Profiles Real-time Temperature across Horizontal Lateral," 10 pages, dated Mar. 31, 2003.

(Continued)

*Primary Examiner*—Giovanna C Wright
(74) *Attorney, Agent, or Firm*—Marlin R. Smith

(57) ABSTRACT

Systems and methods for securing lines to well sand control screens. A method of securing at least one line to a tubular string includes connecting together longitudinal ends of longitudinal sections of the tubular string; then wrapping a shroud circumferentially about the connected tubular string sections; and securing the line to the shroud. A well screen assembly includes a generally tubular filter portion, a shroud wrapped circumferentially about the filter portion, and a retainer which connects opposite circumferential ends of the shroud to each other without being welded to at least one of the shroud ends, with the retainer being positioned on an interior of the shroud. Another well screen assembly includes multiple longitudinal sections of a tubular string, at least one of the longitudinal sections comprising a well screen, and a shroud wrapped circumferentially about the tubular string sections and rotationally secured to the tubular string.

25 Claims, 11 Drawing Sheets

U.S. PATENT DOCUMENTS

| | | | | |
|---|---|---|---|---|
| 7,222,676 | B2 | 5/2007 | Patel et al. | |
| 7,228,898 | B2 | 6/2007 | Grigsby et al. | |
| 7,252,437 | B2 | 8/2007 | Ringgenberg | |
| 2002/0125009 | A1* | 9/2002 | Wetzel et al. | 166/278 |
| 2002/0189808 | A1* | 12/2002 | Nguyen et al. | 166/278 |
| 2003/0000875 | A1 | 1/2003 | Echols et al. | |
| 2004/0035590 | A1 | 2/2004 | Richard | |
| 2006/0159400 | A1 | 7/2006 | Richards et al. | |

OTHER PUBLICATIONS

Oil & Gas Journal, "Fiber Optics, Advanced Technologies Complete ERD Producer/Injector," pp. 47-52, dated Jul. 5, 1999.

SPE 77682, "Fiber Optic Monitoring in Openhole Gravel Pack Completions," 14 pages, dated 2002.

Paulo Tubel, "Intelligent Systems for Optimized Reservoir Management and Improved Oil Recovery," 16 pages, undated.

International Search Report and Written Opinion issued Aug. 27, 2009, for International Patent Application No. PCT/US09/49650, 7 pages.

* cited by examiner

SECUREMENT OF LINES TO WELL SAND CONTROL SCREENS

BACKGROUND

The present disclosure relates generally to equipment utilized and operations performed in conjunction with a subterranean well and, in an embodiment described herein, more particularly provides for securement of lines to well sand control screens.

It is sometimes advantageous to install a line along with a sand control screen in a subterranean well. For example, the line could include an optical fiber for measuring distributed temperature along the screen, an electrical conductor for transmitting command and/or control signals between remote locations, etc.

However, a wellbore is a hazardous environment for lines, and so various means have been devised for protecting the lines. When a line is installed along with a tubular string, means are also provided for securing the line to the tubular string.

Unfortunately, these prior protecting and securing means suffer from various deficiencies. For example, where spaced apart clamps are used to secure the line to the tubular string, the line is left exposed between the clamps. Where a tube is provided along the tubular string in which to install the line, installation becomes very difficult, because the line must be fed through the tube while the tubular string is being connected and installed through a rig floor.

Therefore, it will be appreciated that improvements are needed in the art of securing lines to tubular strings.

SUMMARY

In the present specification, systems and methods are provided which solve at least one problem in the art. One example is described below in which a shroud is used to secure a line to a tubular string. Another example is described below in which the shroud is uniquely constructed so that it may be conveniently installed along with the line on a rig floor while the tubular string is being run into a wellbore.

In one aspect, a method of securing at least one line to a tubular string is provided. The method includes the steps of: connecting together longitudinal ends of at least two longitudinal sections of the tubular string and then wrapping a shroud circumferentially about the connected tubular string sections. The line is secured to the shroud.

In another aspect, a well screen assembly includes a generally tubular filter portion and a shroud wrapped circumferentially about the filter portion. A retainer connects opposite circumferential ends of the shroud to each other without being welded to at least one of the shroud ends. The retainer may be positioned on an interior of the shroud.

In yet another aspect, a well screen assembly is provided which includes multiple longitudinal sections of a tubular string. At least one of the longitudinal sections includes a well screen. A shroud is wrapped circumferentially about the tubular string sections and is rotationally secured to the tubular string.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
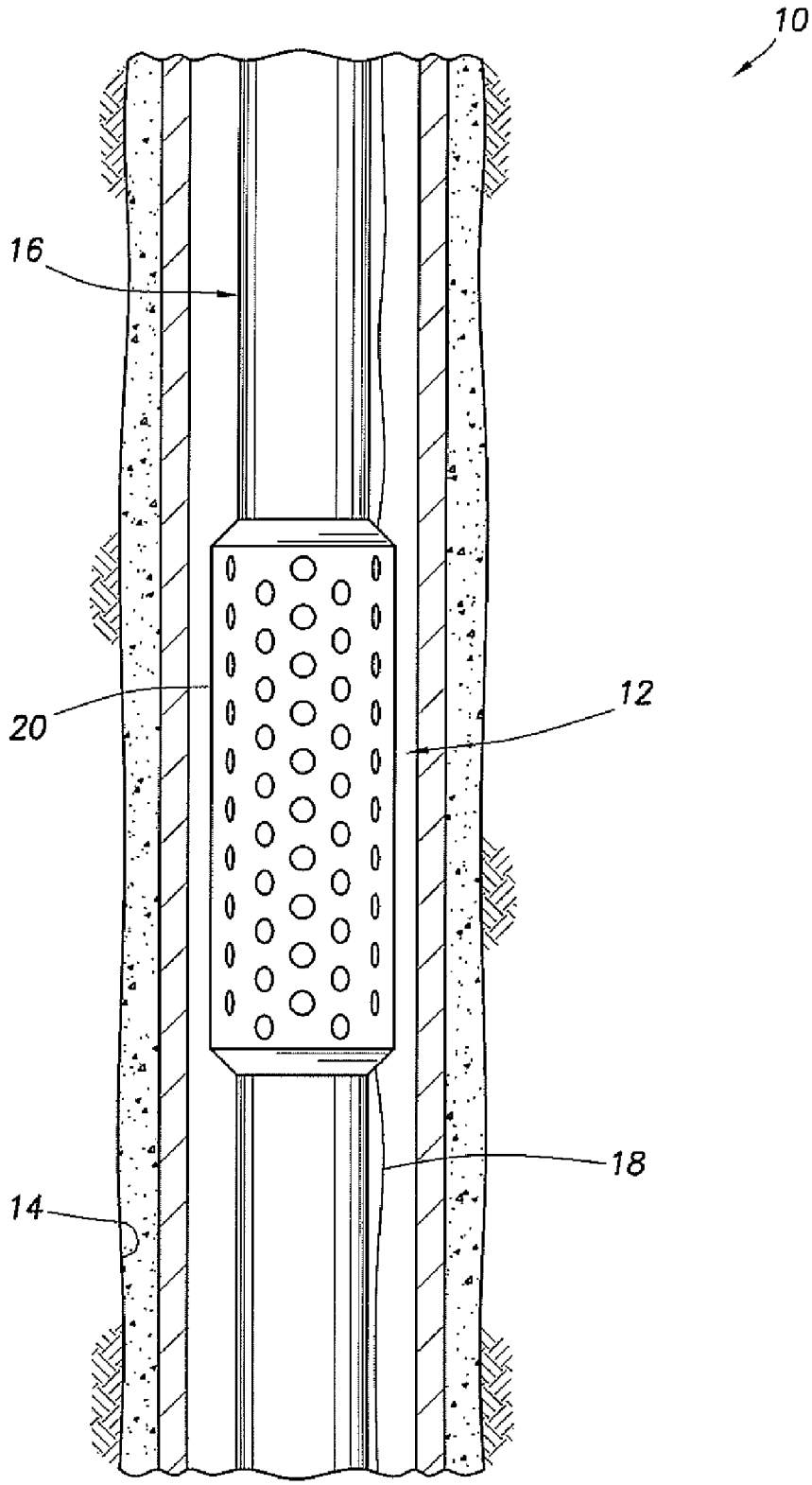
FIG. 1 is a schematic partially cross-sectional view of a well system and associated method embodying principles of the present disclosure.

Representatively illustrated in FIG. 1 is a well system 10 which embodies principles of the present disclosure. In the well system 10, a well screen assembly 12 is installed in a wellbore 14 as part of a tubular string 16. A line 18 extends along the tubular string 16.

In one unique aspect of the system 10, the line 18 is secured and protected by means of a shroud 20 on the well screen assembly 12. In another unique aspect of the system 10, the shroud 20 can be conveniently installed along with the line 18 as the tubular string 16 is being run into the wellbore 14.

Figure 2:
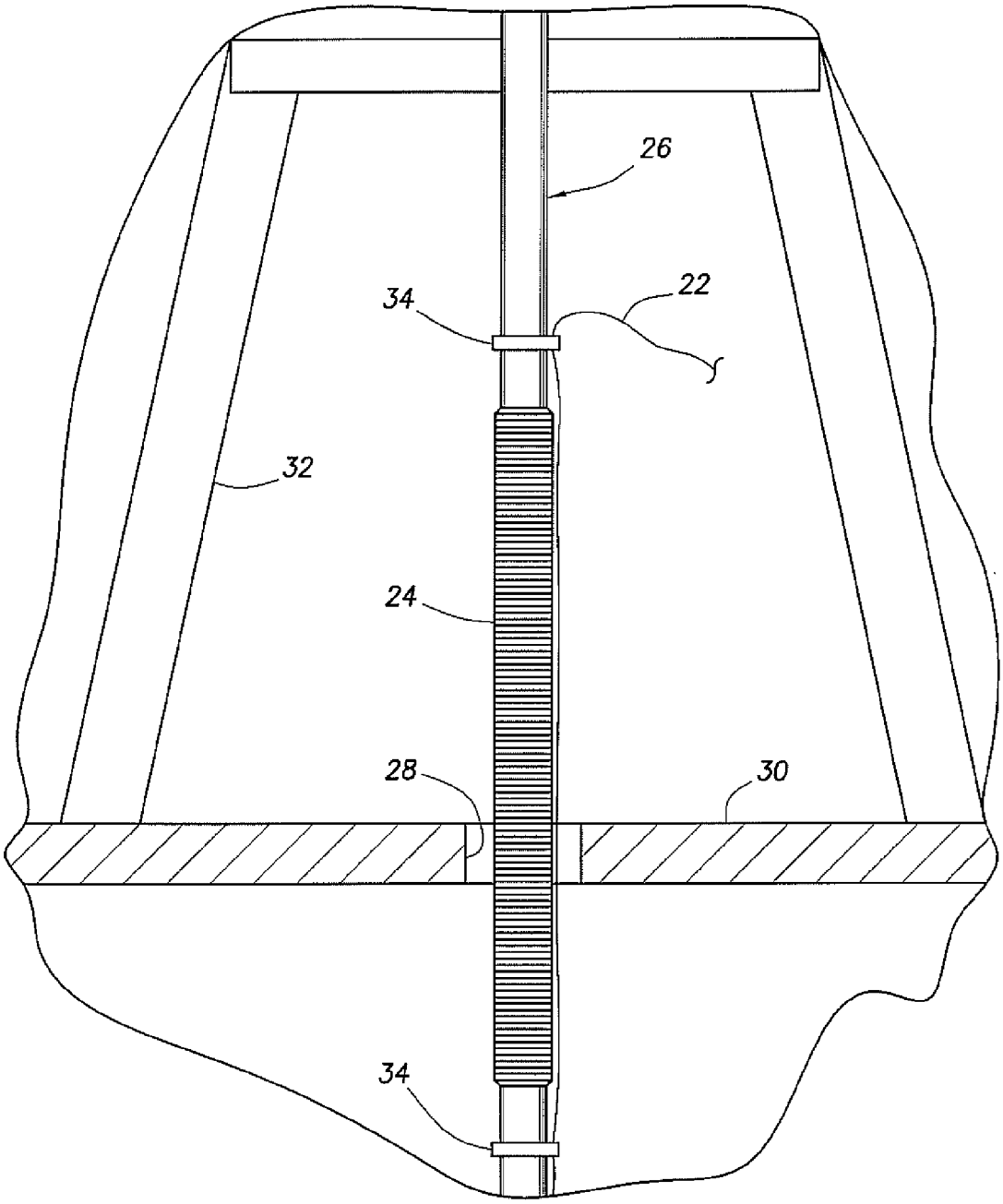
FIG.2 (PRIOR ART)
FIG. 2 is a schematic partially cross-sectional view of a prior art method of installing a line with a screen is assembly.

Referring additionally now to FIG. 2, a prior art method of installing a line 22 and a well screen 24 is representatively illustrated. This illustration demonstrates some of the problems of prior art methods which are solved by utilizing the principles described in this disclosure.

The well screen 24 is interconnected in a tubular string 26, which is inserted through an opening 28 in a floor 30 of an oil rig 32. As the tubular string 26 is installed, the line 22 is secured to the tubular string using spaced apart clamps 34, such as well-known CANNON™ clamps.

Note that the line 22 is unprotected where it extends across the well screen 24, which is typically a relatively large outer diameter portion of the tubular string 26. Furthermore, if a substantial length of multiple well screens 24 are to be installed, additional clamps 34 will generally need to be used between adjacent screens.

In some prior art methods, a tube (not shown) is provided in the screen 24 for the line 22. However, it would be very difficult to thread the line 22 through the tube while the well screen 24 is being installed, since a lower end of the line will generally already be in the well, and an upper end of the line will generally be wrapped about a reel.

In contrast, the present disclosure describes how the line 18 can be installed along with the well screen assembly 12 into the wellbore 14 through the opening 28 in the rig floor 30 in a manner which secures and protects the line, and which enables a substantial length of multiple screens and/or blank pipe sections to be conveniently installed with the line.

Figure 3:
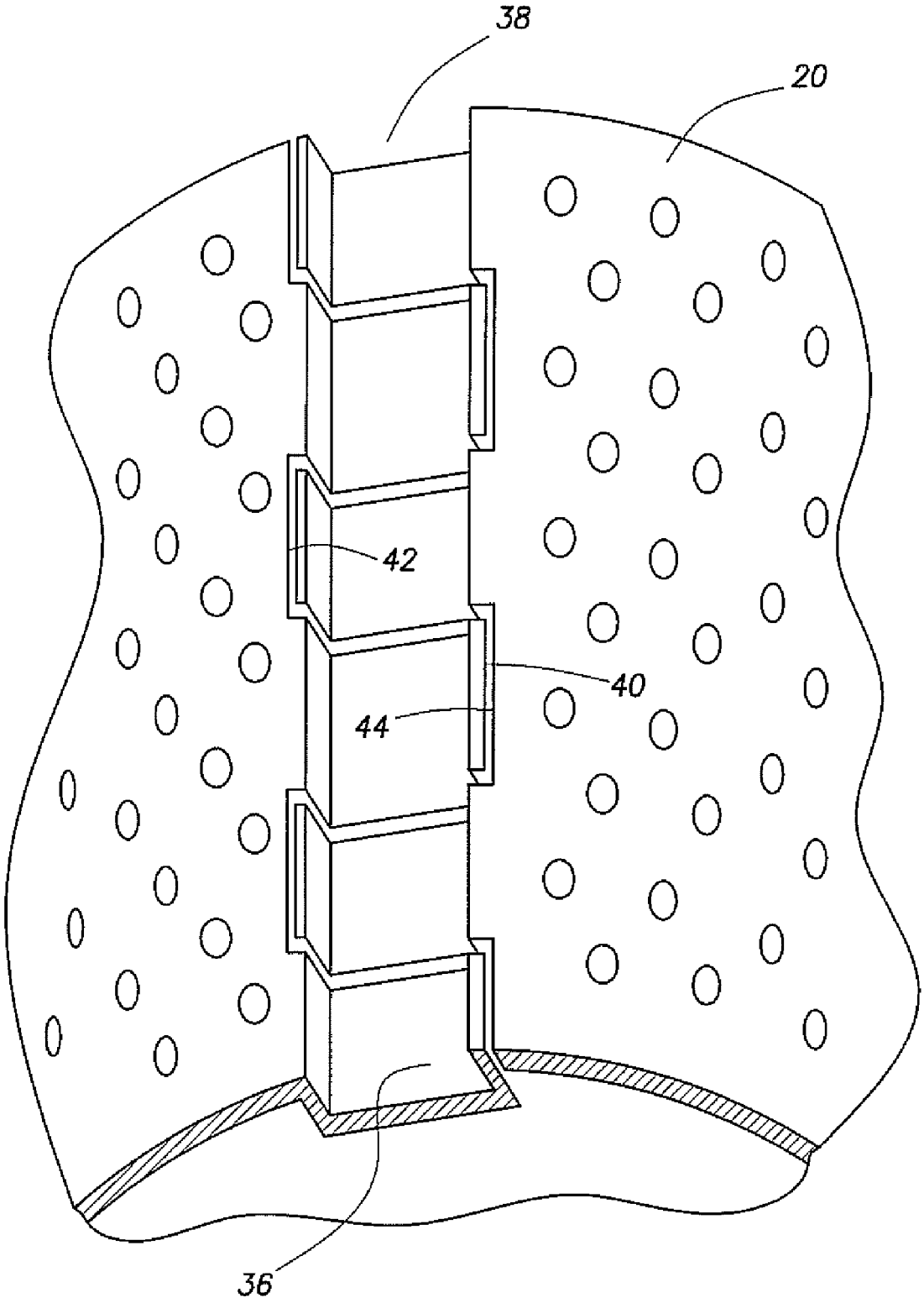
FIG. 3 is a schematic partial isometric view of a shroud for use with a well screen assembly embodying principles of this disclosure.

Referring additionally now to FIG. 3, an example of the shroud 20 used on the well screen assembly 12 is representatively illustrated. In this example, the shroud 20 is provided with a generally longitudinally extending external rectangular groove or recess 36. The recess 36 provides a protected channel 38 in which the line 18 can be secured.

A generally rectangular-shaped "zig-zag" pattern cut 40 separates opposite circumferential ends 42, 44 of the shroud 20. Alternatively, the pattern could be formed on the ends 42, 44 of the shroud 20 prior to forming the shroud into its tubular shape.

Figure 4:
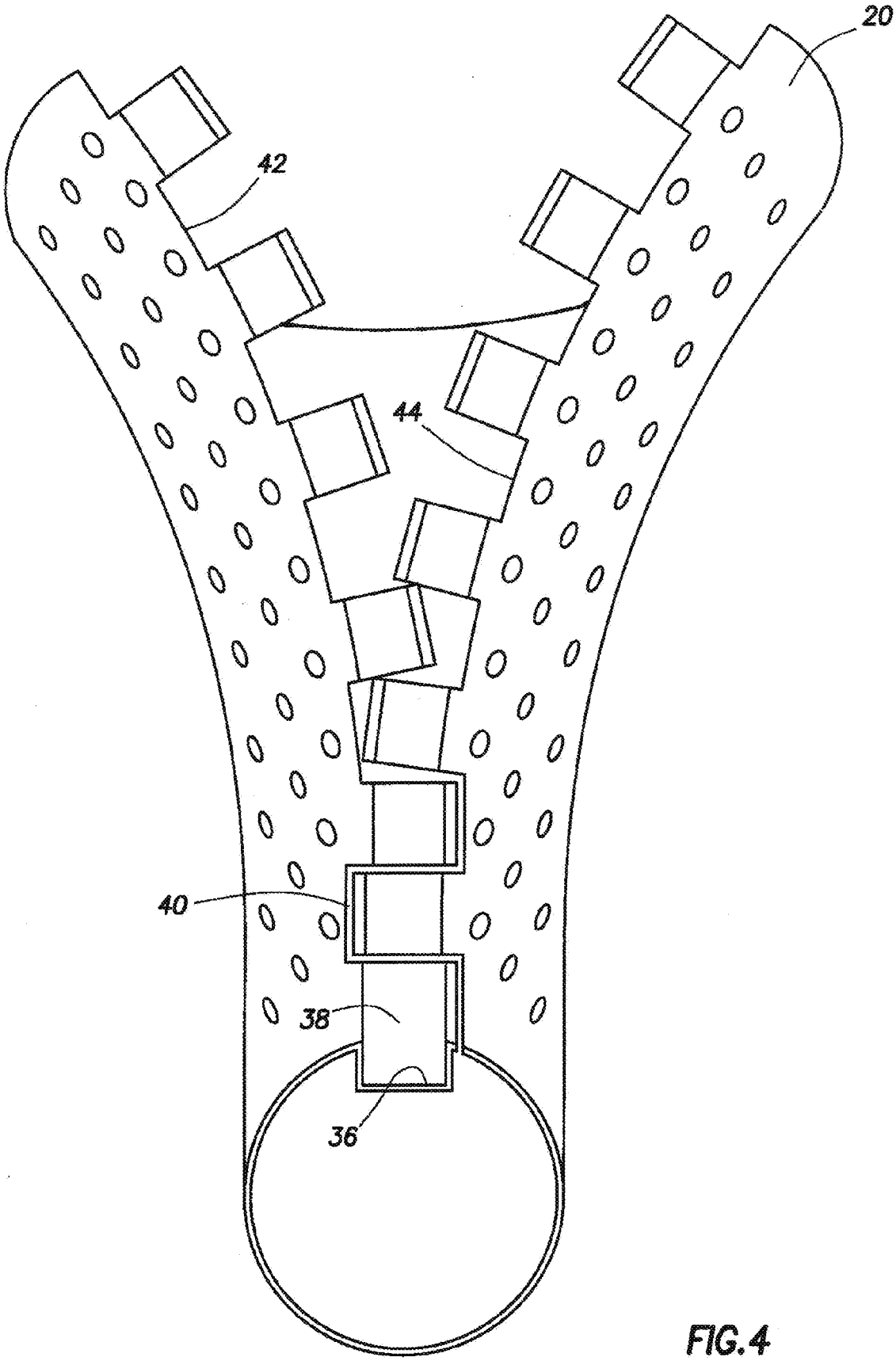
FIG. 4 is a schematic isometric view of the shroud illustrating how circumferential ends of the shroud are separated and joined.

Referring additionally now to FIG. 4, the shroud 20 is representatively illustrated, such that the manner in which the circumferential ends of the shroud 20 can be spread apart (as depicted at the upper portion of the figure) and joined together (as depicted at the lower portion of the figure) to form the channel 38. This capability enables the shroud 20 to be wrapped circumferentially about a filter portion 46 of a well screen 48 (see FIG. 8) and/or other portion of the tubular string 16 (such as a blank pipe section) while the tubular string is being installed on the rig floor 30.

Figure 5:
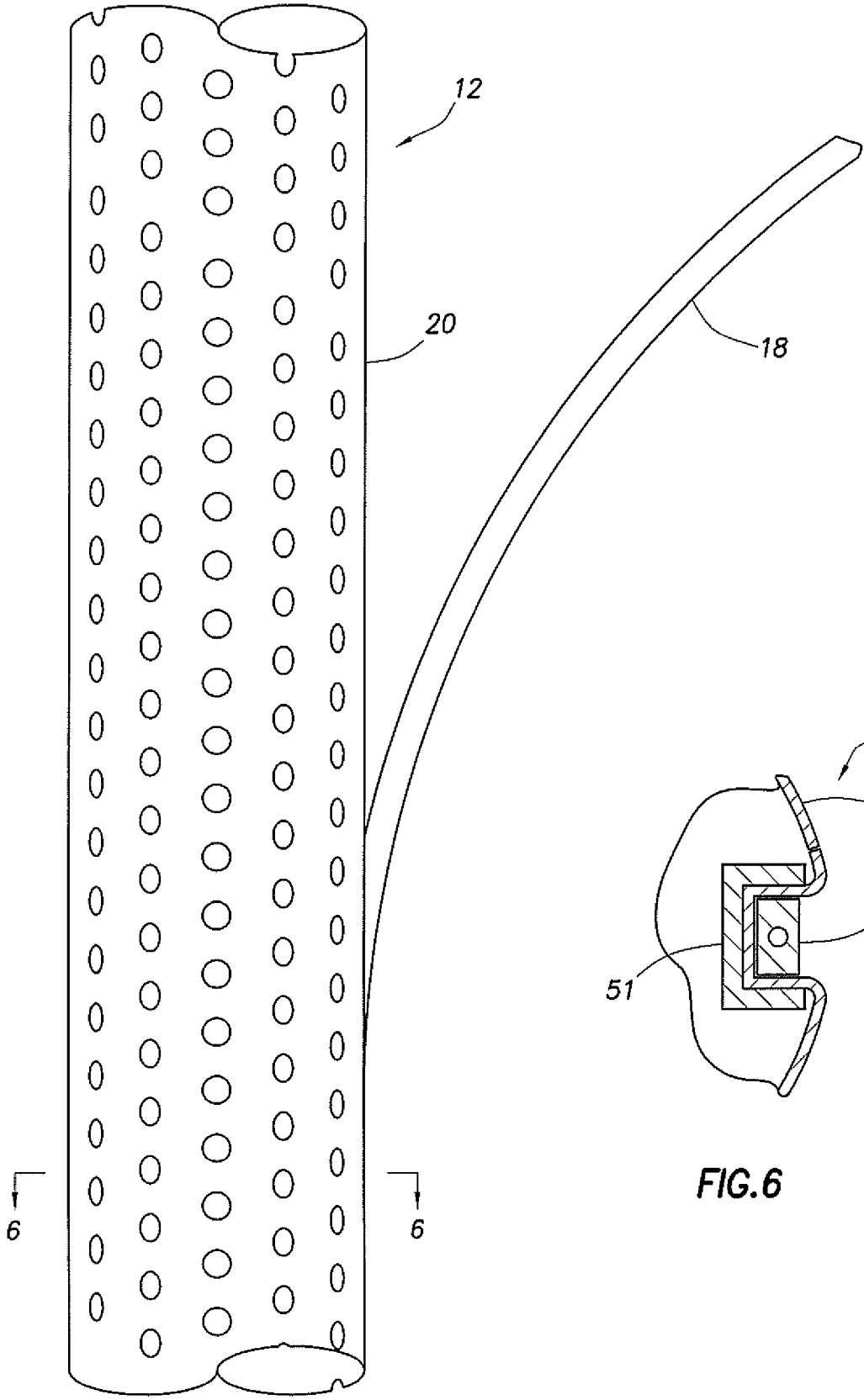
FIG. 5 is a schematic side view of the well screen assembly, with a line being installed therein.

Referring additionally now to FIG. 5, the well screen assembly 12 is representatively illustrated after the shroud 20 has been wrapped about the tubular string 16, and while the line 18 is being inserted into the recess 36 in the shroud. Note that the line 18 can be inserted into the recess 36 continuously and conveniently on the rig floor 30 as the screen assembly 12 is being run into the well as part of the tubular string 16.

Figure 6:
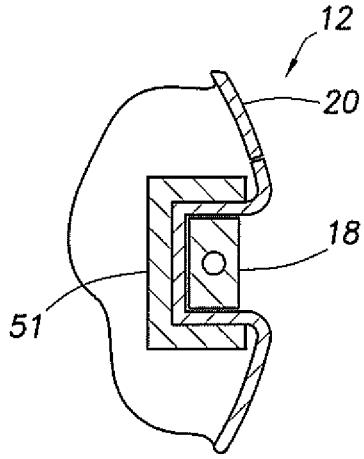
FIG. 6 is a schematic cross-sectional view of a portion of the screen assembly, taken along line 6-6 of FIG. 5.

A cross-sectional view of a portion of the screen assembly 12 is representatively illustrated in FIG. 6. In this view, it may be seen how the line 18 is received in the shroud 20. It may also be seen that the circumferential ends 42, 44 of the shroud 20 are connected together by means of a generally U-shaped retainer 51. In different embodiments, the retainer 51 may connect the ends 42, 44 of the shroud 20 together either before or after the line 18 is installed in the shroud 20.

As depicted in FIG. 6, the line 18 is of the type known to those skilled in the art as a "flat pack" due to its generally rectangular cross-sectional shape. Such a line 18 can include any number of, and any combination of, a fluid conduit (such as a hydraulic control line or a shunt tube), an electrical conductor, a light waveguide (such as an optical fiber), etc., and may be used to conduct fluid pressure, command signals, control signals, data signals, etc.

Figure 7:
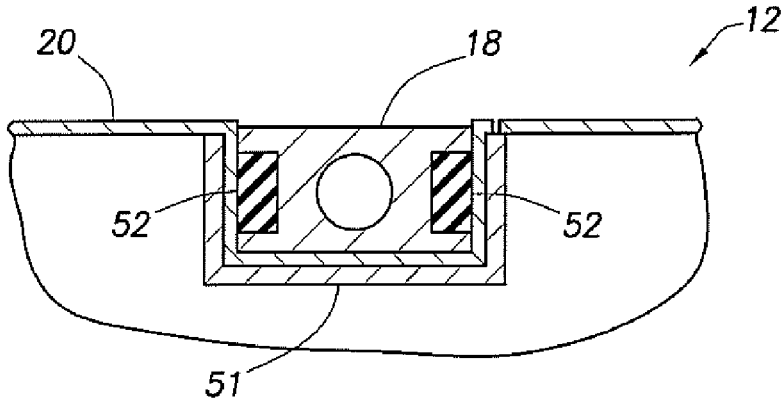
FIG. 7 is an enlarged scale schematic cross-sectional view of a portion of the screen assembly, illustrating another configuration thereof.

Another configuration of the screen assembly 12 is representatively illustrated in FIG. 7. This view is similar in most respects to the configuration of FIG. 6, except that the line 18 is retained in the shroud channel 38 by means of swellable elements 52.

The elements 52 are made of, or at least include, a material which swells (i.e., increases in volume) in response to contact with a preselected fluid. The fluid may be a hydrocarbon fluid, water, a hydrocarbon gas, a well fluid, a fluid carried with the screen assembly, a fluid delivered into the well, or any other fluid. Swelling of the elements 52 secures the line 18 in the recess 36, and may also aid in maintaining the connection between the ends 42, 44 of the shroud 20.

Figure 8:
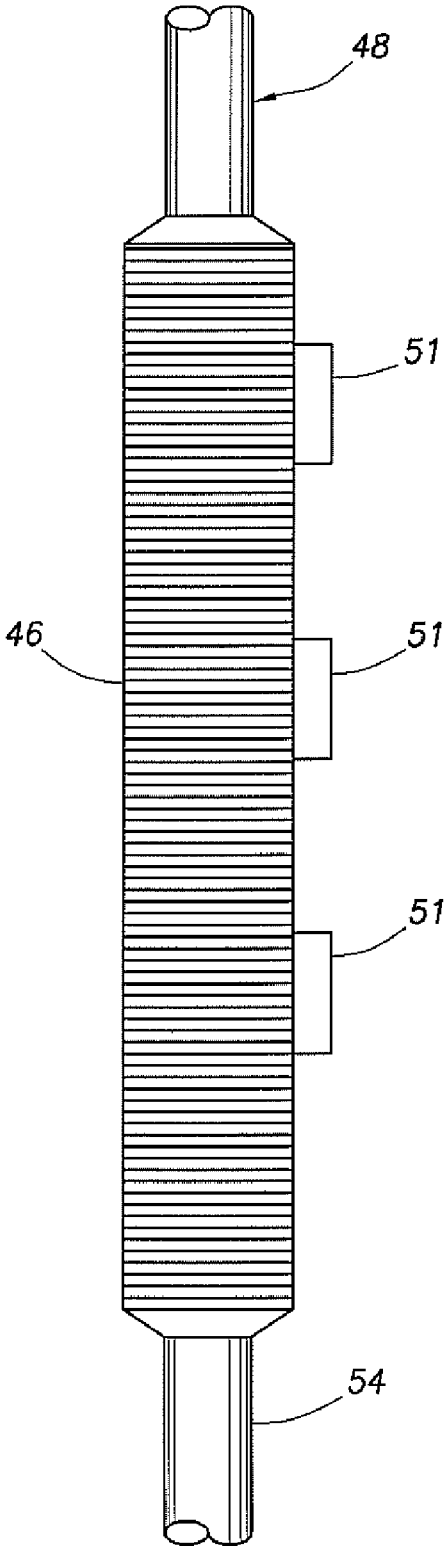
FIG. 8 is a schematic side view of a well screen portion of the assembly, with shroud retainers secured to a filter portion thereof.

Referring additionally now to FIG. 8, the well screen 48 is representatively illustrated prior to installation of the shroud 20. The well screen 48 includes the filter portion 46 (such as a wire wrap, pre-pack, mesh, sintered mesh, or other type of, or combination of, filter media) on a base pipe 54. Other elements (such as perforated tubular elements, etc.) may be included in the well screen 48, internal or external to the filter portion 46.

In this example, multiple spaced apart retainers 51 are attached externally to the filter portion 46. In this manner, the shroud 20 can be wrapped about the well screen 48, and the ends 42, 44 of the shroud can be connected together using the retainers 51. Note that the filter portion 46 can include non-filtering components, such as the perforated tubular elements mentioned above.

Figure 9:
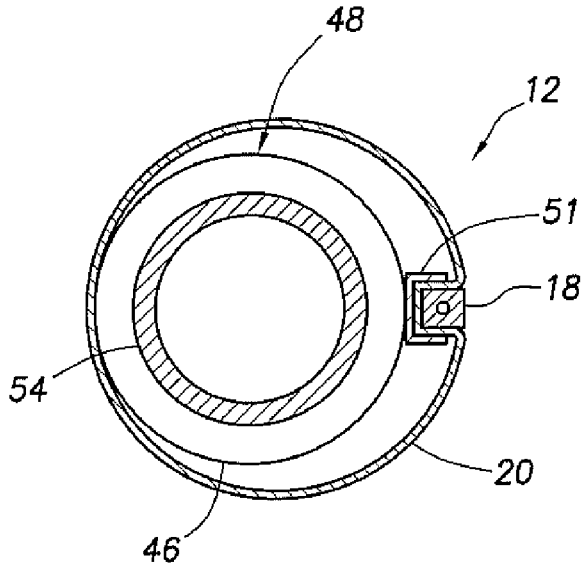
FIG. 9 is a schematic cross-sectional view of the well screen assembly.

A cross-sectional view of the well screen 48 with the shroud 20 wrapped circumferentially about the screen is representatively illustrated in FIG. 9. With the ends 42, 44 of the shroud 20 connected together by the retainer 51, the line 18 is installed in the channel 38. Again, note that the line 18 can be conveniently installed in the shroud 20 as the screen assembly 12 is being run into the well as part of the tubular string 16.

Figure 10:
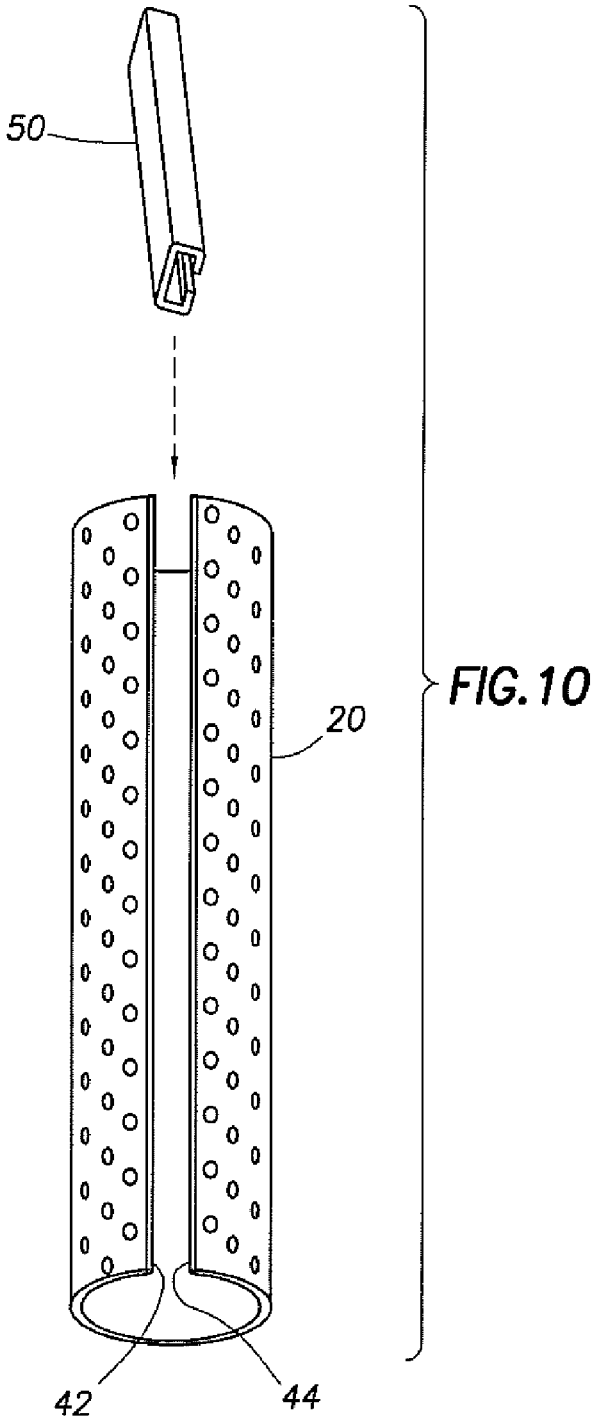
FIG. 10 is a schematic isometric view of another configuration of the shroud and retainer.

Referring additionally now to FIG. 10, another configuration of the shroud 20 and a retainer 50 is representatively illustrated. In this configuration, the retainer 50 is attached externally on the shroud 20, connecting the ends 42, 44 of the shroud together after the shroud is wrapped about the well screen 48.

Figure 11:
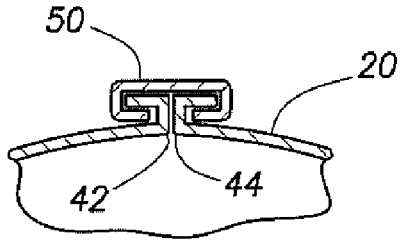
FIG. 11 is a schematic cross-sectional view of the assembled shroud and retainer of FIG. 10.

In FIG. 11, a cross-sectional view of the retainer 50 connecting the ends 42, 44 of the shroud 20 is representatively illustrated. In this example, the line 18 may be positioned between the shroud 20 and the well screen 48 when the retainer 10 is attached to the shroud. In this manner the line 18 is protected and in the screen assembly 12.

Figure 12:
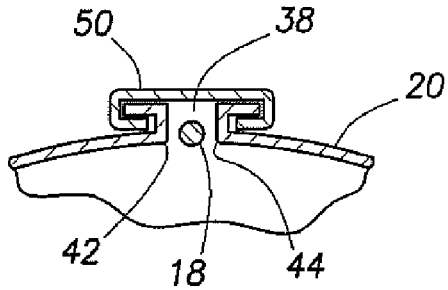
FIG. 12 is a schematic cross-sectional view of another configuration of the assembled shroud and retainer of FIG. 10.

Another configuration of the retainer 50 and shroud 20 is representatively illustrated in FIG. 12. In this configuration, the channel 38 is formed between the ends 42, 44 of the shroud 20 and within the retainer 50. The line 18 can be received in the channel 38 after the shroud 20 has been wrapped about the well screen 48, and prior to installing the retainer 50.

Figure 13:
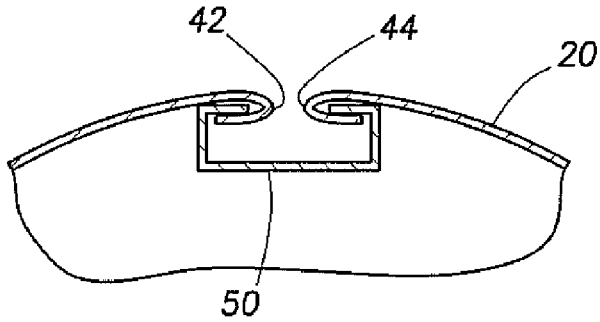
FIG. 13 is a schematic cross-sectional view of another configuration of the assembled shroud and retainer.
Figure 14:
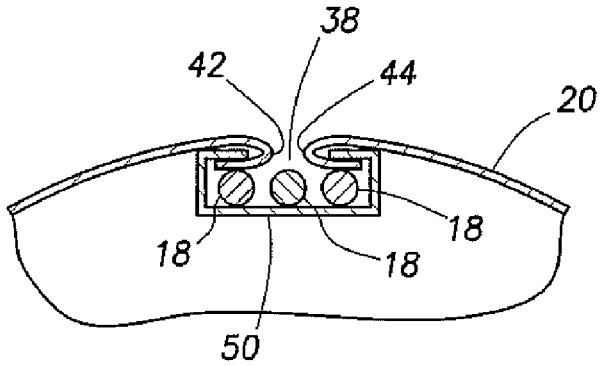
FIG. 14 is a schematic cross-sectional view of yet another configuration of the assembled shroud and retainer.

In FIG. 13, a configuration of the shroud 20 and retainer 50 is representatively illustrated which is similar in most respects to the configuration of FIG. 11. However, in the configuration of FIG. 13, the retainer 50 is internal to the shroud 20. In FIG. 14, multiple lines 18 are shown installed in the channel 38 formed between the ends 42, 44 of the shroud 20 and within the retainer 50.

Figure 16:
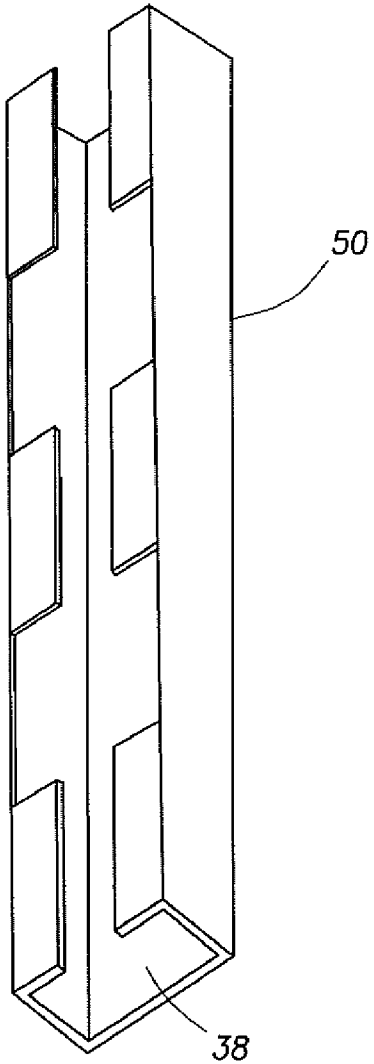
FIG. 16 is a schematic isometric view of another configuration of the retainer.
Figure 15:
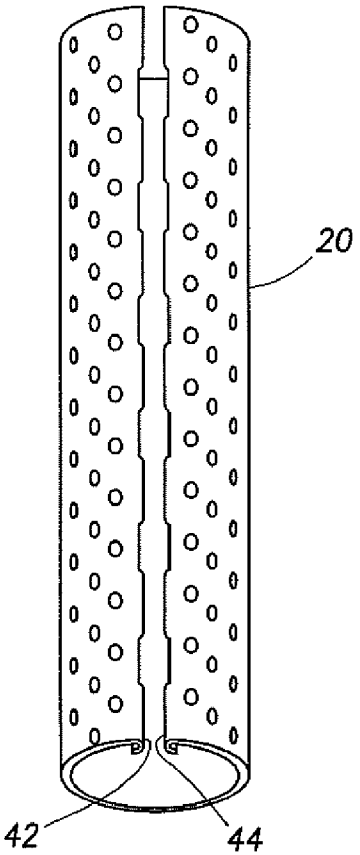
FIG. 15 is a schematic isometric view of another configuration of the shroud.

Yet another configuration of the shroud 20 and retainer 50 is representatively illustrated in FIG. 15 and FIG. 16, respectively. In this configuration, the line 18 can be installed in the channel 38 in the retainer 50, and the ends 42, 44 of the shroud 20 can then be secured together by longitudinally displacing the retainer relative to the shroud only a short distance, due to the castellated configuration of the mating portions of the shroud and retainer. Note that it is not necessary to displace the retainer 50, since the shroud 20 could be displaced instead, in order to connect the ends 42, 44 of the shroud.

Figure 17:
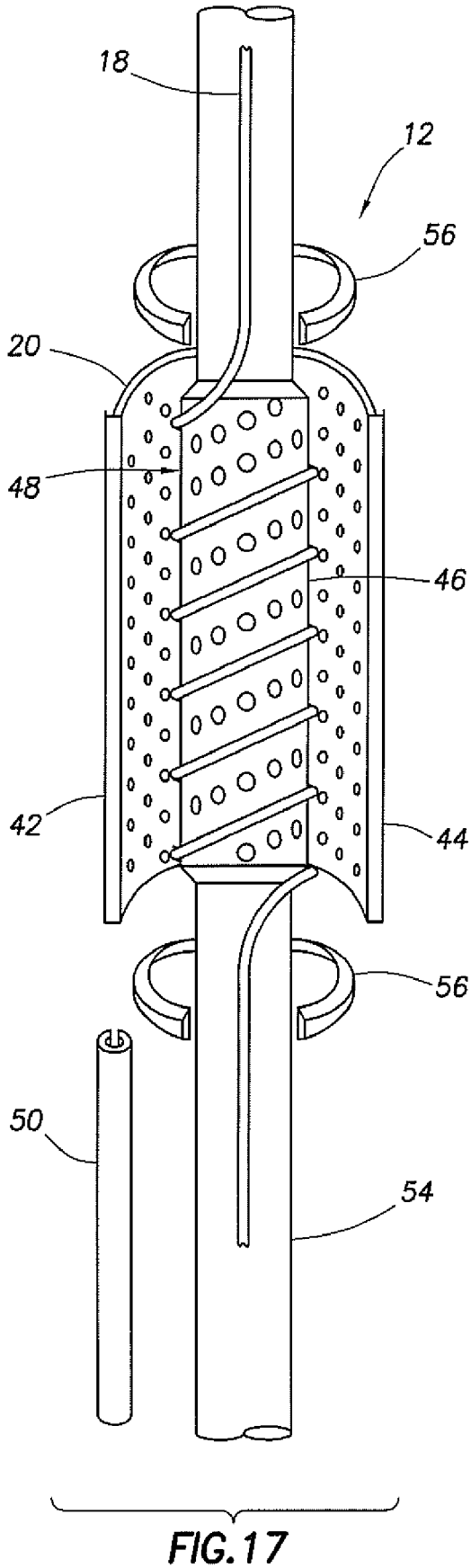
FIG. 17 is a schematic side view of another configuration of the well screen assembly, prior to wrapping the shroud about the well screen.

Referring additionally now to FIG. 17, another configuration of the well screen assembly 12 is representatively illustrated, prior to wrapping the shroud 20 about the well screen 48. Also depicted in FIG. 17 is another configuration of the retainer 50, which in this example has a generally circular cross-sectional shape.

Figure 18:
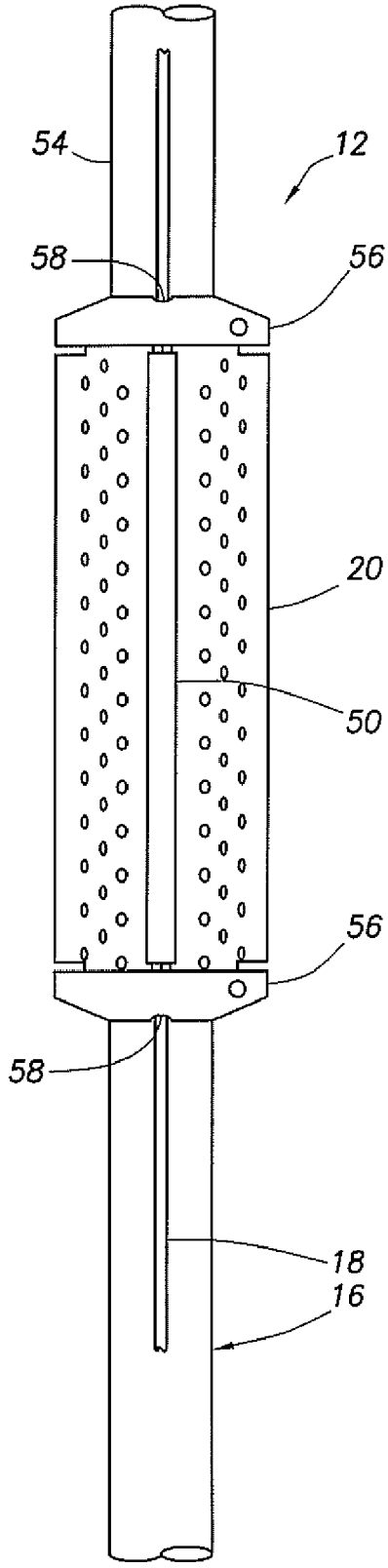
FIG. 18 is a schematic side view of the well screen assembly of FIG. 17, after securing the shroud about the well screen.

In addition, note that the line 18 is wrapped helically about the well screen 48, and that securing devices 56 are provided for longitudinally and rotationally securing the shroud 20 to the well screen 48 (or adjacent sections of the tubular string 16). As depicted in FIG. 18, the shroud 20 is preferably rotationally secured to the tubular string 16 by the securing devices 56 after the shroud has been wrapped about the well screen 48, and the retainer 50 has been used to connect the ends 42, 44 of the shroud.

In the event that the line 18 is received in the channel 38 described above for any of the other embodiments, openings 58 in the securing devices 56 can be aligned with the channel prior to rotationally securing the shroud 20 to the tubular string 16.

Figure 19:
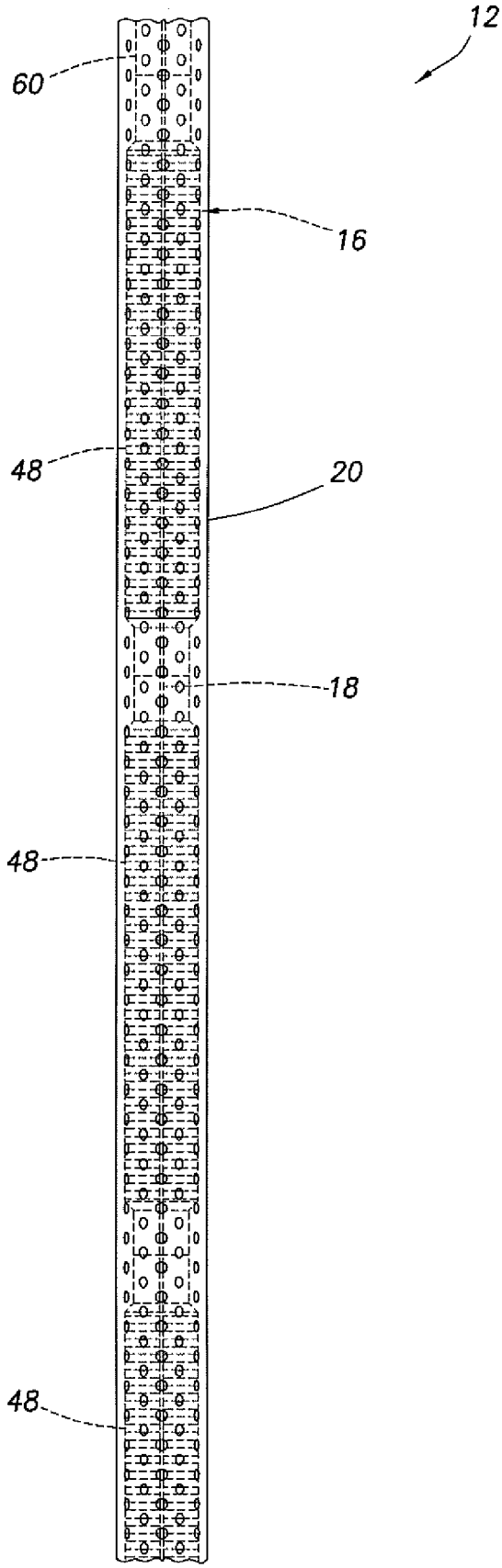
FIG. 19 is a schematic side view of another configuration of the well screen assembly, wherein the shroud is secured about multiple sections of a tubular string.

Referring additionally now to FIG. 19, another configuration of the well screen assembly 12 is representatively illustrated. In this configuration, the shroud 20 is installed about multiple well screens 48 interconnected as longitudinal sections of the tubular string 16. The shroud 20 is also installed about a blank pipe 60 section of the tubular string 16.

This configuration enables the line 18 to be conveniently installed along multiple longitudinal sections of the tubular string 16 (which may include any number and/or combination of well screens 48 and blank pipes 60) after the sections have been connected together on the rig floor 30, and while the tubular string is being run into the wellbore 14. The shroud 20 can be rotationally secured to the tubular string 16 after longitudinal ends of the sections have been connected together, for example, using the securing devices 56 described above to secure the shroud to the tubular string. Any of the shroud 20 and retainer 50 configurations described above may be used in the well screen assembly 12 depicted in FIG. 19.

Furthermore, note that multiple shrouds 20 can be attached about a single well screen 48 or other section of the tubular string 16.

It may now be fully appreciated that this disclosure provides many advancements to the art of securing lines to tubular strings. For example, in the system 10, the line 18 is secured and protected by means of a shroud 20 on the well screen assembly 12. Circumferential ends 42, 44 of the shroud 20 are secured to each other without welding to either or both of the ends. In addition, the shroud 20 can be conveniently installed along with the line 18 as the tubular string 16 is being run into the wellbore 14.

More particularly, described above is a method of securing at least one line 18 to a tubular string 16, with the method including the steps of: connecting together longitudinal ends of at least two longitudinal sections 48 and/or 60 of the tubular string 16; then wrapping a shroud 20 circumferentially about the connected tubular string sections; and securing the line 18 to the shroud 20.

The shroud wrapping step may be performed during installation of the tubular string 16 into a subterranean well, and/or may be performed while the tubular string extends through an opening 28 in a rig floor 30.

The longitudinal sections of the tubular string 16 may include at least two well screens 48. The longitudinal sections may include at least one well screen 48 and at least one blank pipe 60.

The wrapping step may include securing opposite circumferential ends 42, 44 of the shroud 20 to each other. The securing step may include attaching a retainer 50 or 51 to the ends 42, 44 of the shroud 20. The attaching step may be performed without welding to at least one of the circumferential ends 42, 44 of the shroud 20.

The securing step may include securing the line 18 to and/or within the retainer 50 or 51.

The attaching step may include attaching the retainer 50 or 51 to an interior or exterior of the shroud 20.

Also described above is a well screen assembly 12 which includes a generally tubular filter portion 46, a shroud 20 wrapped circumferentially about the filter portion 46, and a retainer 50 which connects opposite circumferential ends 42, 44 of the shroud 20 to each other without being welded to at least one of the shroud ends. The retainer 50 may be positioned on an interior of the shroud 20.

At least one line 18 may be secured by the retainer 50. The line 18 may comprise at least one of a fluid conduit, an electrical conductor, a light waveguide, a fluid pressure conductor, a command signal conductor, a control signal conductor and a data signal conductor.

The retainer 50 may be connectable to the shroud ends 42, 44 after the line 18 is secured by the retainer. The line 18 may be received in the retainer 50.

Opposite longitudinal ends of the line 18 may be open at opposite longitudinal ends of the shroud 20, thereby providing fluid communication through the line between the opposite longitudinal ends of the shroud.

The shroud 20 may be wrapped circumferentially about the filter portion 46 and at least one other longitudinal section 48 and/or 60 of a tubular string 16. Opposite longitudinal ends of the shroud 20 may be rotationally secured straddling the filter portion 46 and the longitudinal section 48 or 60 of the tubular string 16.

Also described above is a well screen assembly 12 which includes multiple longitudinal sections 48 and/or 60 of a tubular string 16, with at least one of the longitudinal sections comprising a well screen 48. A shroud 20 is wrapped circumferentially about the tubular string sections 48 and/or 60 and is rotationally secured to the tubular string 16.

The well screen assembly 12 may also include at least one securing device 56 which rotationally secures the shroud 20 to the tubular string 16. At least one line 18 may extend through the securing device 56.

An opening 58 in the securing device 56 may be aligned with a channel 38 extending along the tubular string 16 sections. The channel 38 may be formed in a retainer 50 which secures opposite circumferential ends 42, 44 of the shroud 20 to each other. The retainer 50 may be positioned internal to the shroud 20.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of securing at least one line to a tubular string, the method comprising the steps of:

connecting together longitudinal ends of at least two longitudinal sections of the tubular string;

then wrapping a shroud circumferentially about at least one of the connected tubular string sections during installation of the tubular string into a subterranean well; and securing the line to the shroud.

2. The method of claim 1, wherein the shroud wrapping step is performed while the tubular string extends through an opening in a rig floor.

3. The method of claim 1, wherein the longitudinal sections include at least two well screens.

4. The method of claim 1, wherein the longitudinal sections include at least one well screen and at least one blank pipe.

5. The method of claim 1, wherein the wrapping step further comprises securing opposite circumferential ends of the shroud to each other.

6. The method of claim 5, wherein the securing step further comprises attaching a retainer to the ends of the shroud.

7. The method of claim 6, wherein the attaching step is performed without welding to at least one of the circumferential ends of the shroud.

8. The method of claim 6, wherein the securing step further comprises securing the line by the retainer.

9. The method of claim 6, wherein the securing step further comprises securing the line within the retainer.

10. The method of claim 6, wherein the attaching step further comprises attaching the retainer to an exterior of the shroud.

11. The method of claim 6, wherein the attaching step further comprises attaching the retainer to an interior of the shroud.

12. A well screen assembly, comprising:

a generally tubular filter portion;

a shroud wrapped circumferentially about the filter portion, the shroud including formed circumferential ends; and a retainer which engages the formed circumferential ends, thereby connecting the circumferential ends of the shroud to each other without using fasteners and without being welded to at least one of the shroud ends.

13. The screen assembly of claim 12, wherein the retainer is positioned on an interior of the shroud and at least one line is secured by the retainer.

14. The screen assembly of claim 13, wherein the line comprises at least one of a fluid conduit, an electrical conductor, a light waveguide, a fluid pressure conductor, a command signal conductor, a control signal conductor and a data signal conductor.

15. The screen assembly of claim 13, wherein the retainer is connected to the shroud ends after the line is received in the retainer.

16. The screen assembly of claim 13, wherein the line is received in the retainer.

17. The screen assembly of claim 13, wherein opposite longitudinal ends of the line are open at opposite longitudinal ends of the shroud, thereby providing fluid communication through the line between the opposite longitudinal ends of the shroud.

18. The screen assembly of claim 12, wherein the shroud is wrapped circumferentially about the filter portion and at least one other longitudinal section of a tubular string.

19. The screen assembly of claim 18, wherein opposite longitudinal ends of the shroud are rotationally secured straddling the filter portion and the longitudinal section of the tubular string.

20. A well screen assembly, comprising:

multiple longitudinal sections of a tubular string, at least one of the longitudinal sections comprising a well screen;

a shroud wrapped circumferentially about the tubular string sections; and at least one securing device which longitudinally and rotationally secures the shroud to the tubular string, wherein the securing device permits a change in the longitudinal and radial position of the shroud on the tubular string after opposite circumferential ends of the shroud have been connected.

21. The well screen assembly of claim 20, wherein at least one line extends through the securing device.

22. The well screen assembly of claim 21, wherein an opening in the securing device is aligned with a channel extending along the tubular string sections.

23. The well screen assembly of claim 22, wherein the channel is formed in a retainer which secures opposite circumferential ends of the shroud to each other.

24. The well screen assembly of claim 23, wherein the retainer is positioned internal to the shroud.

25. A method of securing at least one line to a tubular string, the method comprising the steps of:

connecting together longitudinal ends of at least two longitudinal sections of the tubular string;

then wrapping a shroud circumferentially about at least one of the connected tubular string sections by forming the shroud around the tubular string, wherein the wrapping step is performed during installation of the tubular string into a subterranean well;

then securing opposite circumferential ends of the shroud to each other; and securing the line to the shroud.

* * * * *